US007577375B2

(12) United States Patent
Ida

(10) Patent No.: US 7,577,375 B2
(45) Date of Patent: Aug. 18, 2009

(54) IMAGE FORMING APPARATUS WITH SUPPORT MEMBER

(75) Inventor: Akihiro Ida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 316 days.

(21) Appl. No.: 11/527,576

(22) Filed: Sep. 27, 2006

(65) Prior Publication Data

US 2007/0189799 A1 Aug. 16, 2007

(30) Foreign Application Priority Data

Feb. 14, 2006 (JP) ..... P2006-036851

(51) Int. Cl.
*G03G 15/02* (2006.01)

(52) U.S. Cl. ..... 399/100; 399/176

(58) Field of Classification Search ..... 399/176, 399/100, 168

See application file for complete search history.

(56) References Cited

U.S. PATENT DOCUMENTS

| | | | | |
|---|---|---|---|---|
| 5,619,311 | A * | 4/1997 | Kurokawa et al. | 399/176 |
| 6,381,432 | B1 * | 4/2002 | Hattori | 399/176 |
| 7,317,883 | B2 * | 1/2008 | Watanabe et al. | 399/100 |
| 2003/0044196 | A1 * | 3/2003 | Amemiya et al. | 399/100 |
| 2003/0215259 | A1 * | 11/2003 | Suda et al. | 399/100 |
| 2005/0191081 | A1 | 9/2005 | Muraishi et al. | |
| 2006/0067727 | A1 * | 3/2006 | Suda et al. | 399/100 |
| 2006/0280518 | A1 * | 12/2006 | Kamoshida et al. | 399/100 |
| 2007/0104504 | A1 * | 5/2007 | Terai et al. | 399/100 |
| 2007/0280724 | A1 * | 12/2007 | Park | 399/100 |
| 2007/0286635 | A1 * | 12/2007 | Matsui et al. | 399/100 |

FOREIGN PATENT DOCUMENTS

| | | |
|---|---|---|
| CN | 1101135 A | 4/1995 |
| JP | 2-272594 | 7/1990 |
| JP | 5-297690 | 12/1993 |
| JP | 6-236093 | 8/1994 |
| JP | 7-261518 | 10/1995 |

* cited by examiner

*Primary Examiner*—Susan S Lee
(74) *Attorney, Agent, or Firm*—Morgan, Lewis & Bockius LLP

(57) ABSTRACT

An image forming apparatus includes a rotatable image carrier, a charging roll and a support member. The image carrier has a surface on which an electrostatic latent image is to be formed. The charging roll follows rotation of the image carrier. The charging roll charges the surface of the image carrier at a predetermined potential. The support member is in contact with the charging roll at a contact point. The contact point is on a downstream of a nip portion between the image carrier and the charging roll in a rotation direction of the charging roll. The contact point is on an upstream of a plane, which contains an axis line of the charging roll and is perpendicular to a plane defined by an axis line of the image carrier and the axis line of the charging roll.

5 Claims, 4 Drawing Sheets

IMAGE FORMING APPARATUS WITH SUPPORT MEMBER

TECHNICAL FIELD

This invention relates to an electrophotographic image forming apparatus and in particular to an image forming apparatus improved in preventing from moving, a contact-type charging roll, which abuts against a photoconductor to charge a surface of the photoconductor.

DESCRIPTION OF THE RELATED ART

For example, in a contact-type charging device of an image forming apparatus according to a related art, a charging member to which a charge voltage is applied is elastically supported with a spring so as to press the charging member against a photosensitive drum of an image carrier. The charging member transfers charges directly therefrom to the photosensitive drum, to thereby charge the surface of the photosensitive drum at a predetermined potential. The charging member rotates with following rotation of the photosensitive drum, using a contact frictional force in a pressure-contact part.

However, if the charging member follows the rotation of the photosensitive drum, at the time of receiving rotation drive from the photosensitive drum, the frictional drive force drags the charging member so as to vary an axial position of the charging member relative to the photosensitive drum from a predetermined position. Thereby, nip nonuniformity or load nonuniformity occurs in the pressure-contact portion. As a result, abrasion unevenness of the photosensitive drum would be caused to occur with time and finally, image density unevenness would be caused to occur.

SUMMARY

According to an aspect of the invention, an image forming apparatus includes a rotatable image carrier, a charging roll and a support member. The image carrier has a surface on which an electrostatic latent image is to be formed. The charging roll follows rotation of the image carrier. The charging roll charges the surface of the image carrier at a predetermined potential. The support member is in contact with the charging roll at a contact point. The contact point is on a downstream of a nip portion between the image carrier and the charging roll in a rotation direction of the charging roll. The contact point is on an upstream of a plane, which contains an axis of the charging roll and is perpendicular to a plane defined by an axis of the image carrier and the axis of the charging roll.

BRIEF DESCRIPTION OF THE DRAWINGS

Exemplary embodiments of the invention will be described in detail based on the following figures, wherein.

DETAILED DESCRIPTION

Referring now to the accompanying drawings, exemplary embodiments of the invention will be described below.

Figure 1:
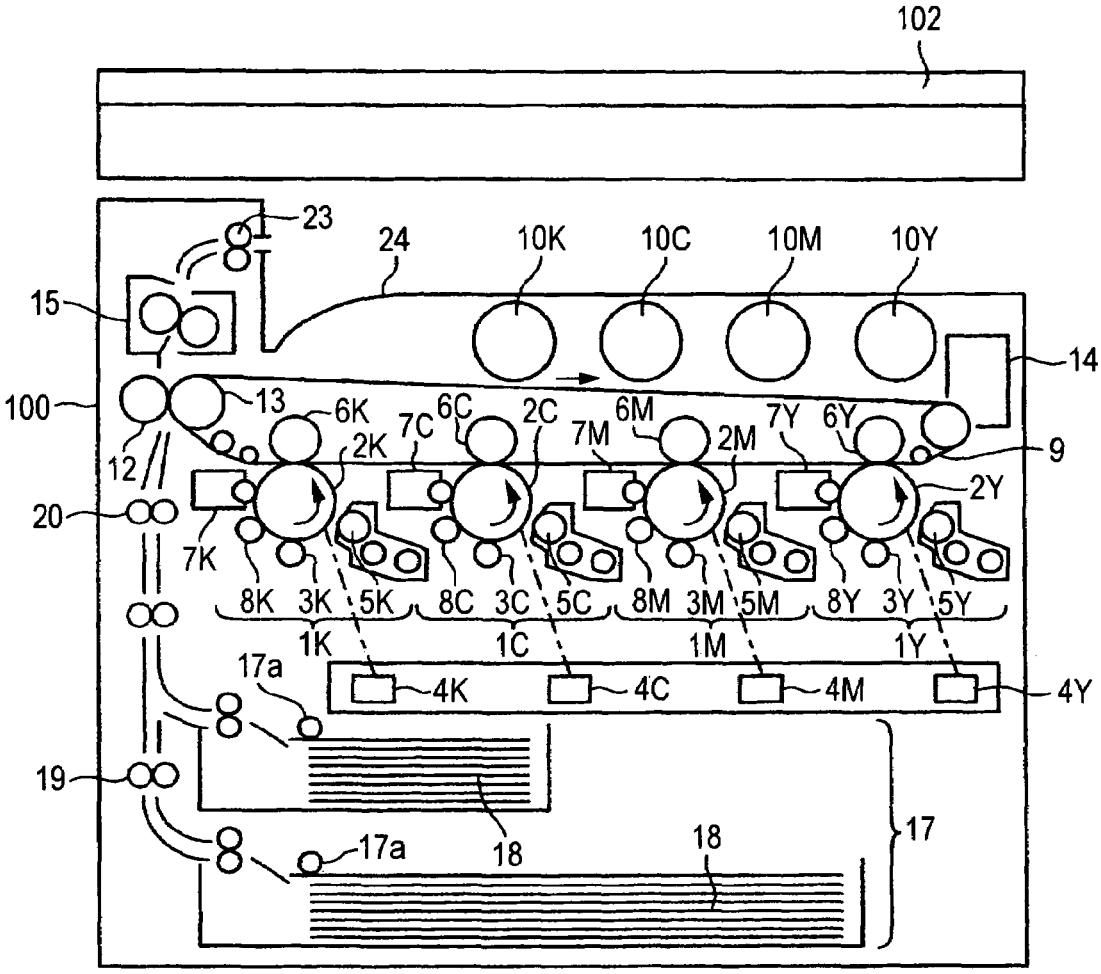
FIG. 1 is a schematic drawing to show the configuration of an image forming apparatus according to one exemplary embodiment of the invention.

To begin with, the schematic configuration of an image forming apparatus according to one exemplary embodiment of the invention will be discussed with reference to FIG. 1. FIG. 1 is a schematic drawing to show the configuration of a tandem color image forming apparatus 100 according to this exemplary embodiment of the invention.

Color image information of a color original document read through an image reader 102 and color image information sent from a personal computer (not shown) or an image data input unit (not shown), are input into the image forming apparatus 100. The image forming apparatus 100 performs image processing on the input image information.

In FIG. 1, reference signs 1Y, 1M, 1C, and 1K denote image forming units for forming yellow (Y), magenta (M), cyan (C), and black (K) color toner images, respectively. The image forming units 1Y, 1M, 1C, and 1K are disposed in series in this order along a traveling direction of an endless intermediate transfer belt 9 stretched on plural tension rolls. The intermediate transfer belt 9 is an intermediate transfer body onto which color toner images formed in order by the image forming units 1Y, 1M, 1C, and 1K are transferred in a superposition state on each other. The intermediate transfer belt 9 is inserted between photosensitive drums 2Y, 2M, 2C, and 2K and first transfer rolls 6Y, 6M, 6C, and 6K disposed facing the photosensitive drums 2Y, 2M, 2C, and 2K. The photosensitive drums 2Y, 2M, 2C, and 2K function as electrostatic latent image carriers corresponding to the image forming units 1Y, 1M, 1C, and 1K. The intermediate transfer belt 9 is movable in a circulation manner in an arrow direction. The color toner images multiple-transferred onto the intermediate transfer belt 9 are transferred onto a recording paper 18, which is a recording medium and is fed from a paper cassette 17, simultaneously. Then, the color toner images are fixed on the recording paper 18 by a fuser 15. The recording paper 18 on which a color image is formed is discharged to the outside of the image forming apparatus.

The image reader 102 illuminates an original document placed on platen glass with a light source (not shown) and reads a reflected light image from the original at a predetermined resolution by an image read device such as a CCD sensor through a scanning optical system.

Each image forming unit 1Y, 1M, 1C, 1K is configured likewise and includes the photosensitive drum 2Y, 2M, 2C, 2K, which rotate at a predetermined rotation speed in the arrow direction; a charging roll 3Y, 3M, 3C, 3K functioning as a charging device for uniformly charging the surface of the photosensitive drum 2Y, 2M, 2C, 2K; an exposure device 4Y, 4M, 4C, 4K for emitting light of an image corresponding to each color for forming an electrostatic latent image on the surface of the photosensitive drum 2Y, 2M, 2C, 2K; a developing device 5Y, 5M, 5C, 5K for developing the electrostatic latent image formed on the photosensitive drum 2Y, 2M, 2C, 2K; and a detachable toner cartridge 10Y, 10M, 10C, 10K for supplying predetermined color toner to the developing device 5Y, 5M, 5C, 5K, a cleaning device 7Y, 7M, 7C, 7K.

Further, in the photosensitive drum 2Y, 2M, 2C, 2K of the exemplary embodiment, a surface of a metal drum, which rotates in the arrow direction, is coated with a photosensitive layer made of an organic photosensitive material, an amorphous selenium-based photosensitive material and/or an amorphous silicon-based photosensitive material. Also, the charging roll 3Y, 3M, 3C, 3K comes in contact with the surface of the photosensitive drum 2Y, 2M, 2C, 2K and charges the photosensitive layer at a predetermined potential by a bias having an AC voltage/AC current superposed on a DC voltage/DC current.

In the exemplary embodiment, a cleaning member (not shown) for the charging roll is disposed for each of the charging rolls 3Y, 3M, 3C, and 3K. The cleaning member is pressed against the corresponding charging roll 3Y, 3M, 3C, 3K by a predetermined press force of an elastic member such as a spring.

The image forming process in the described image forming apparatus will be described by taking the image forming unit 1Y for forming a yellow toner image as a representative example.

First, when a bias voltage/current having an AC voltage/AC current superposed on a predetermined DC voltage/DC current is applied to the charging roll 3Y, the surface (photosensitive layer) of the photosensitive drum 2Y is uniformly charged. Next, for example, scan exposure corresponding to a yellow image is executed by a laser beam, which is output from the exposure device 4Y based on the image information read through the image reader 102. An electrostatic latent image corresponding to the yellow image is formed on the surface (photosensitive layer) of the photosensitive drum 2Y.

The developing device 5Y forms the electrostatic latent image corresponding to the yellow image into a yellow toner image. The first transfer roll 6Y functioning as a part of a first transfer device applies the press force and electrostatic suction force to thereby transfer the yellow toner image onto the intermediate transfer belt 9. The drum cleaning device 7Y scrapes the yellow toner remaining on the photosensitive drum 2Y after the first transfer. Thereafter, a electricity removing device 8Y removes electricity on the surface of the photosensitive drum 2Y. Then, the charging roll 3Y charges the photosensitive drum 2Y again for the next image formation cycle.

In the image forming apparatus 100 for forming a multicolor image, the image forming process similar to that described above is also executed in the image forming units 1M, 1C, and 1K at the timings considering the relative position difference among the image forming units 1Y, 1M, 1C, and 1K. A full color toner image is formed the intermediate transfer belt 9 in a superposition state. If the intermediate transfer belt 9, for example, a synthetic resin film of polyimide, having flexibility is formed like a belt and both ends of the synthetic resin film formed like a belt are connected by means of welding, an endless belt is formed.

The full color toner image primarily transferred onto the intermediate transfer belt 9 is secondarily transferred onto the recording paper 18 transported to a second transfer position at a predetermined timing by the press force and electrostatic suction force of a backup roll 13 for supporting the intermediate transfer belt 9 and a second transfer roll 12 for being pressed against the backup roll 13 at a predetermined timing.

On the other hand, a paper feed roll 17*a* feeds the recording paper 18 having a predetermined size from a paper cassette 17 functioning as a recording paper storage section placed at the bottom of the image forming apparatus 100. Plural transport rolls 19 and plural registration rolls 20 transport the fed recording paper 18 to the second transfer position of the intermediate transfer belt 9 at the predetermined timing. The backup roll 13 and the second transfer roll 12, which function as a second transfer device as described above, transfer the full color toner image from the intermediate transfer belt 9 to the recording paper 18 simultaneously.

The recording paper 18 onto which the full color toner image is secondarily transferred from the intermediate transfer belt 9 is detached from the intermediate transfer belt 9. Then, the recording paper 18 is transported to the fuser 15 disposed on the downstream of the second transfer device. The fuser 15 fixes the toner image onto the recording paper 18 by heat and pressure. The recording paper 18 after the toner image is fixed thereonto is discharged to an ejection tray 24 through a discharge roll 23.

Further, the remaining toner on the intermediate transfer belt 9, which is not transferred onto the recording paper 18 by the second transfer device, is transported to a belt cleaning device 14 while the remaining toner is deposited on the intermediate transfer belt 9. Then, the belt cleaning device 14 removes the remaining toner from the intermediate transfer belt 9 for the next image formation.

Figure 2:
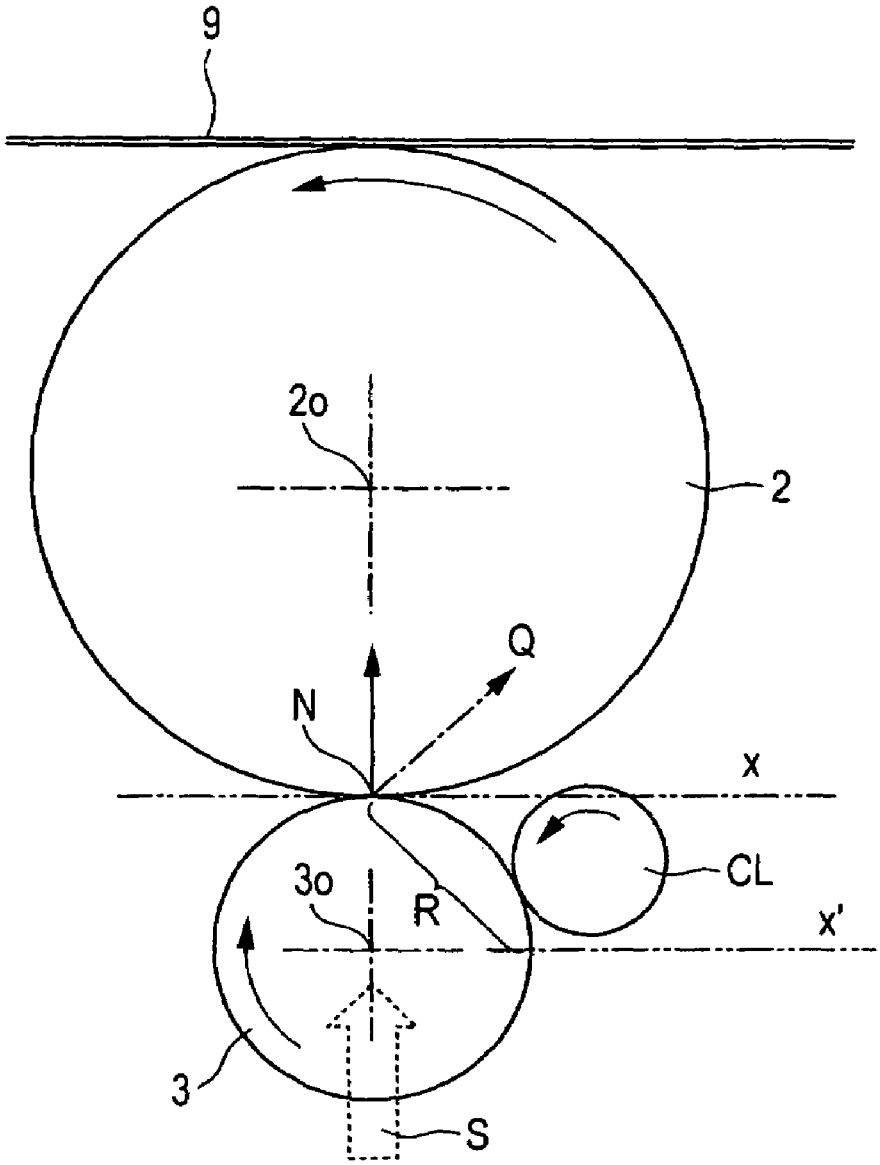
FIG. 2 is a drawing to schematically show placement of a cleaning member for charging roll according to the exemplary embodiment of the invention.
Figure 3:
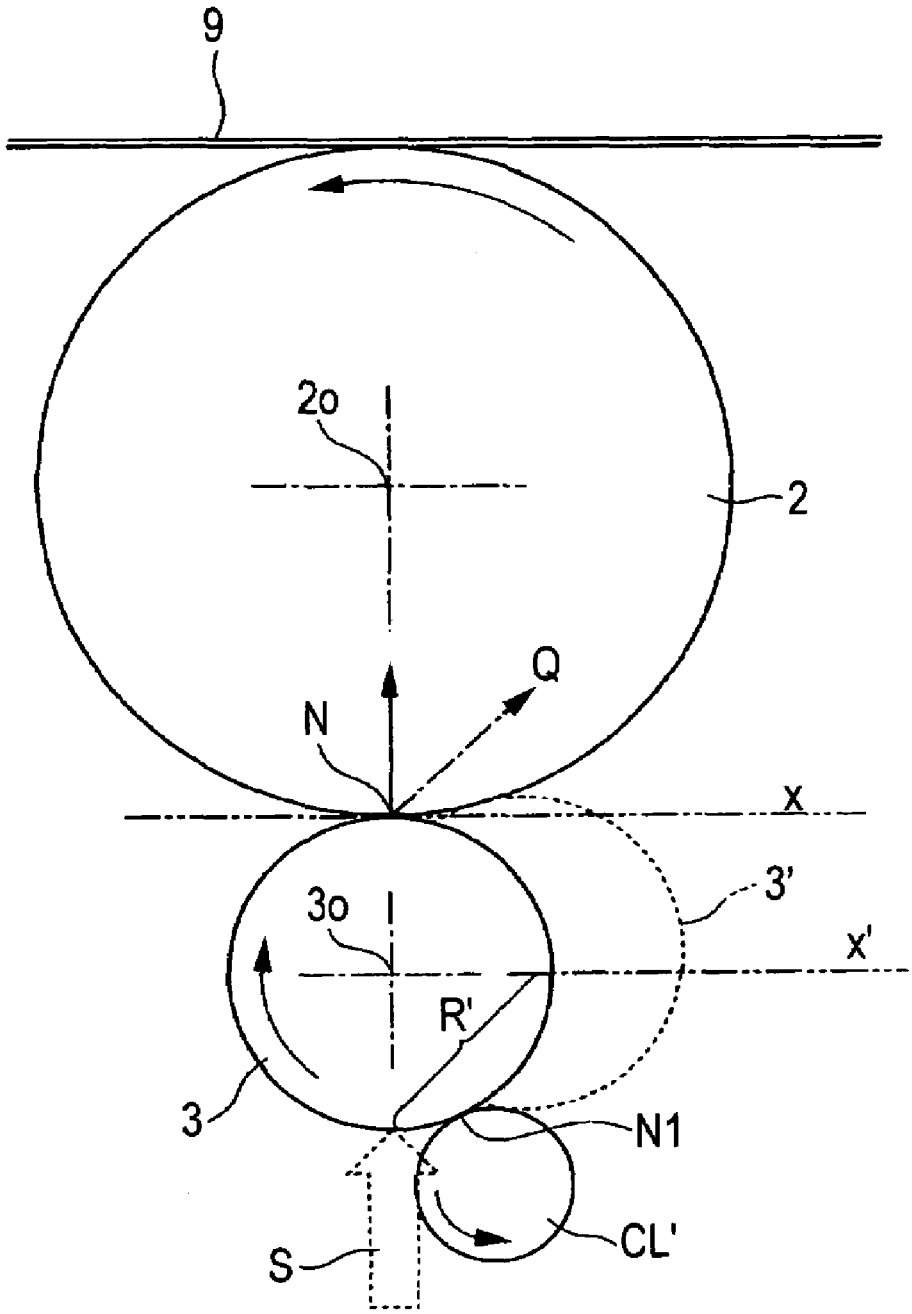
FIG. 3 is a drawing to schematically show placement of a cleaning member for a charging roll of a comparative example.

Next, the configurations of each charging roll and each cleaning member for the charging roll according to the exemplary embodiment of the invention will be described with reference to FIGS. 2 and 3. FIG. 2 is a drawing to schematically show placement of the cleaning member for the charging roll according to the exemplary embodiment of the invention. FIG. 3 is a drawing to schematically show placement of a cleaning member for a charging roll of a comparative example. The image forming units 1Y, 1M, 1C, and 1K have the similar configuration and their components (for example, the photosensitive drums 2Y, 2M, 2C, and 2K) also have the similar configurations. Therefore, the reference numerals are described as generic numerals (for example, the photosensitive drum 2) for simplicity.

As shown in FIG. 2, the image forming apparatus according to the exemplary embodiment includes the contact-type charging roll 3 and a cleaning member CL for the charging roll 3. The charging roll 3 comes in contact with the surface of the photosensitive drum 2, which is driven to be rotatable so that a predetermined bias voltage/current is applied from a high-voltage power source (not-shown) to the charging roll 3. An elastic member such as a spring supports the cleaning member CL so that the cleaning member CL abuts against the surface of the charging roll 3 with a predetermined pressure-contact force.

A bearing slide member (not shown) supports the charging roll 3 according to the exemplary embodiment. The charging roll 3 abuts against the photosensitive drum 2 with a given load and a biting amount (in the example, 0.2 mm) by a pressure spring S from below the bearing member, to thereby form a nip portion (pressure-contact part) N. The charging roll 3 follows the rotation of the photosensitive drum 2 by the frictional force of the nip portion N, and rotates at the same speed as the photosensitive drum 2.

The charging roll 3 is a roll-like rotation member provided by coating a conductive layer made of a conductive synthetic resin and/or conductive synthetic rubber onto on the surface of a cored bar made of metal such as stainless steel. The resistance value of the conductive layer is adjusted to a predetermined value. A mold release layer may be formed on the surface of the conductive layer, if necessary. For example, AC voltage on which DC voltage is superposed is applied to the cored bar, whereby gap discharge is caused to occur in a minute gap between the charging roll 3 and the photosensitive drum 2. As a result, the surface of the photosensitive drum 2 is charged at a predetermined potential.

The cleaning member CL, which is a roll-like rotation member like the charging roll 3, is supported by a bearing member (not shown). The cleaning member CL abuts against the charging roll 3 with a center distance producing a predetermined biting amount (in the example, 0.75 mm) to form a nip portion N1. The cleaning member CL follows the rotation of the charging roll 3. The cleaning member CL of the exemplary embodiment includes a shaft member of SUS and a sponge. The sponge is a porous elastic body and may be formed of urethane sponge or a member having low adhesive properties (for example, melamine resin) as compared with urethane sponge.

By the way, generally, in the image forming apparatus, an exposure face such as a laser irradiation face of the exposure device 4 (see FIG. 1) and a developing face of the developing device 5 (see FIG. 1) are formed on a downstream of the nip portion N between the charging roll 3 and the photosensitive drum 2 along the peripheral surface of the photosensitive drum 2. Thus, a cleaning member CL' of the comparative example is placed to avoid such an area. If the charging roll 3 is placed below the photosensitive drum 2 as in the exemplary embodiment, usually the cleaning member CL' is placed below the charging roll 3 as shown in FIG. 3.

However, it turned out by inventor's research that, for example, if the cleaning member CL' is placed so that the nip portion N1 is formed in a peripheral surface R' of the lower right half in FIG. 3 viewed from the center of the charging roll 3, a push force in a center 2*o* direction of the photosensitive drum 2 and a drag force (force in the right direction in FIG. 3) in the rotation direction of the photosensitive drum 2 (in this example, counterclockwise) act on the charging roll 3 urged by the photosensitive drum 2. As a result, a force along an arrow Q direction (in FIG. 3, right slanting upper direction) acts on the charging roll 3. Thus, the charging roll 3 moves to a position as indicated by dashed lines 3' so as to climb over the peripheral surface of the cleaning member CL'. This phenomenon may cause nip nonuniformity and/or load nonuniformity and cause an image defect accompanying abrasion unevenness of the photosensitive drum 2 and/or a charging failure with time.

Then, in the image forming apparatus according to the exemplary embodiment, a support member, which prevents the charging roll 3 from moving, is provided to abut against the outer peripheral surface of the charging roll 3. Furthermore, the support member is disposed in a peripheral surface area R of the charging roll 3, on a downstream of the nip portion N between the photosensitive drum 2 and the charging roll 3 along the rotation direction of the charging roll 3 and on an upstream of a plane X', which contains a center axis line 3*o* of the charging roll 3 and is parallel to the tangential plane (nip plane) X at the nip portion N (that is, is perpendicular to a plane defined by an axis line of the photosensitive drum 2 and an axis line of the charging roll 3). Specifically, the support member may be provided by placing the cleaning member CL in the area R.

Here, the "axis line of the image carrier" and the "axis line of the charging roll" mean a straight line connecting center points of the image carrier and a straight line connecting center points of the charging roll, respectively.

In the above described exemplary embodiment, as the support member, the cleaning member CL is placed so that the nip portion N1 between the cleaning member CL and the charging roll 3 is located on a downstream of the nip portion N between the photosensitive drum 2 and the charging roll 3. Furthermore, the cleaning member CL is placed in the region R, which is on the upstream of the plane X' passing through the center axis 3*o* of the charging roll 3 and parallel to the nip plane X. Therefore, it is made possible to reliably prevent the charging roll 3 from moving due to the rotation of the photosensitive drum 2, with the simple configuration. That is, if a resultant force Q acts on the charging roll 3 in the direction in which the charging roll 3 moves to the position indicated by the dashed lines 3' shown in FIG. 3, the cleaning member CL placed in the area R in such a direction can reliably suppress and reduce the move of the charging roll 3 (position variation).

The cleaning member CL is used as the support member, thereby contributing to miniaturization and cost reduction of the image forming apparatus because of a decrease in the number of parts without a new component added.

Further, the cleaning member CL functioning as the support member is formed as the roll-like rotation member. Thereby, the rotation load of the charging roll 3 can be lessened and stable rotation of the charging roll 3 can be realized.

Figure 4:
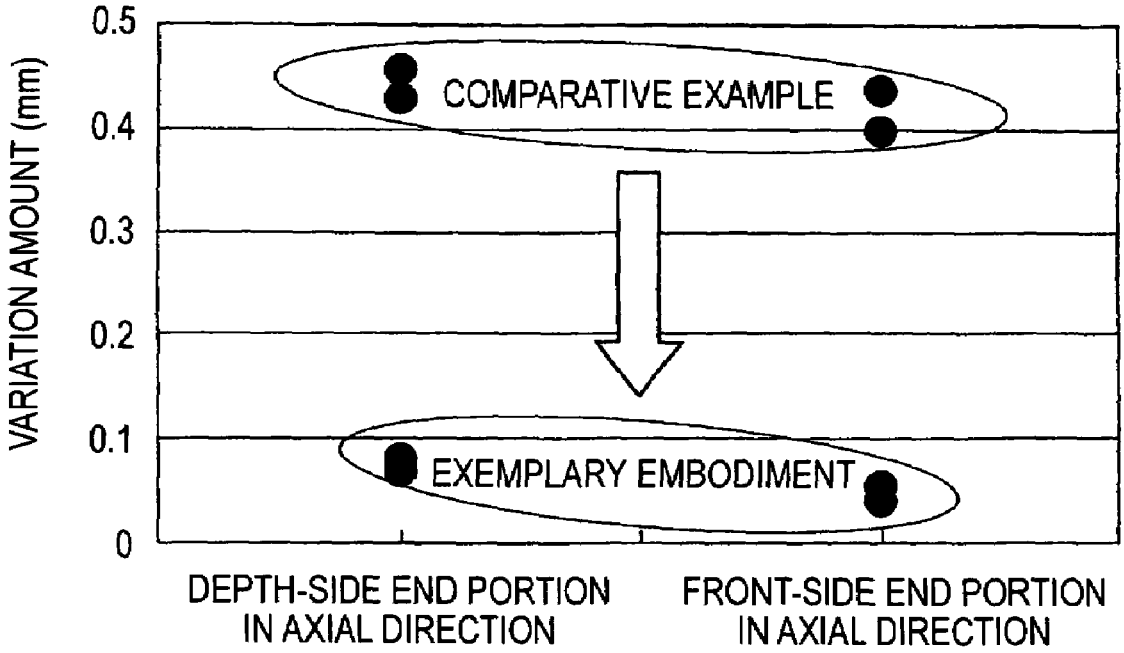
FIG. 4 is a drawing to show the evaluation results of shaft shift amounts of charging rolls on the front side and the depth side in an axial direction of respective image forming apparatuses.

Next, FIG. 4 shows the comparison result of the image forming apparatus of the comparative example and the image forming apparatus according to the exemplary embodiment of the invention. FIG. 4 is a drawing to show the evaluation results of shaft shift amounts (axis misalignment amounts) of charging rolls on the front side and the depth side in the axial direction of each image forming apparatus.

The image forming apparatus of the exemplary embodiment includes the cleaning member CL placed in the predetermined area R shown in FIG. 2. The image forming apparatus of the comparative example includes the cleaning member CL' placed in the area R' shown in FIG. 3.

As a variation amount of the charging roll 3 caused by movement of the photosensitive drum 2, the shaft shift amounts (axis misalignment amounts) at both axial ends of each charging roll 3 after driven for 10 seconds from a still state are measured using a laser displacement meter (resolution 0.1 μm, measuring range ±1 mm). This is because the variation amount at the axial end becomes large.

As easily understood from FIG. 4, the shaft shift amounts (axis misalignment amounts) at both axial ends are each 0.4 to 0.5 mm in the image forming apparatus of the comparative example. While, the shaft shift amounts (axis misalignment amounts) at both axial ends fall each within the range of 0 to 0.1 mm in the image forming apparatus according to the exemplar embodiment of the invention. That is, the exemplary embodiment can drastically prevents the position shift (axis shift) of the charging roll 3 as compared with the image forming apparatus of the comparative example.

In the exemplary embodiment, as the support member, the cleaning member CL is placed in the predetermined peripheral surface area R of the charging roll 3. However, if the cleaning member CL cannot be placed in such an area R because of the apparatus layout, for example, a small-diameter roll-like (pin-like) member may be placed in the area R so as to abut against the charging roll 3.

If such a configuration is adopted, move of the charging roll 3 caused by the rotation of the photosensitive drum 2 can also be prevented directly and reliably with the simple configuration although the number of components is increased.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable image carrier having a surface on which an electrostatic latent image is to be formed;

a charging roll that follows rotation of the image carrier, the charging roll charging the surface of the image carrier at a predetermined potential; and a support member being in contact with the charging roll at a contact point, which is on a downstream of a nip portion between the image carrier and the charging roll in a rotation direction of the charging roll, the contact point located downstream of the nip portion and between the nip portion and a plane, which contains an axis line of the charging roll and is perpendicular to a plane defined by an axis line of the image carrier and the axis line of the charging roll, wherein the support member follows rotation of the charging roll.

2. The apparatus according to claim 1, wherein the support member cleans a surface of the charging roll.

3. The apparatus according to claim 1, wherein the support member is a roll-like rotation member.

4. The apparatus according to claim 2, wherein the support member is a roll-like rotation member.

5. An image forming apparatus comprising:

a rotatable image carrier having a surface on which an electrostatic latent image is to be formed;

a charging roll that follows rotation of the image carrier, the charging roll that charges the surface of the image carrier at a predetermined potential; and support means being in contact with the charging roll at a contact point, which is on a downstream of a nip portion between the image carrier and the charging roll in a rotation direction of the charging roll, the contact point located downstream of the nip portion and between the nip portion and a plane, which contains an axis line of the charging roll and is perpendicular to a plane defined by an axis line of the image carrier and the axis line of the charging roll, wherein the support means is a roll-like rotation member that cleans a surface of the charging roll and follows rotation of the charging roll.

* * * * *